US005269422A

United States Patent [19]

Chevrette

[11] Patent Number: 5,269,422

[45] Date of Patent: Dec. 14, 1993

[54] WINDSHIELD AND PROTECTING DIVIDER ASSEMBLY

[75] Inventor: Eric Chevrette, St-ligori, Canada

[73] Assignee: Gestion 127 Inc., Berthierville, Canada

[21] Appl. No.: 20,639

[22] Filed: Feb. 22, 1993

[51] Int. Cl.[5] ..... B65D 85/48

[52] U.S. Cl. ..... 206/448; 206/454

[58] Field of Search ..... 206/454, 448

[56] References Cited

U.S. PATENT DOCUMENTS

| | | | |
|---|---|---|---|
| 2,476,623 | 7/1949 | Petersen | 206/454 |
| 3,043,488 | 7/1962 | Warwick | 206/448 |
| 3,044,615 | 7/1962 | Richardson | 206/448 |
| 3,133,687 | 5/1964 | Fremion | 206/448 X |
| 4,182,450 | 1/1980 | Kryger | 206/454 X |
| 4,225,043 | 9/1980 | Lastik | 206/448 |

*Primary Examiner*—William I. Price

[57] ABSTRACT

A windshield divider and support assembly for supporting two or more motor vehicles windshields spaced apart in a container, as disclosed. The divider support assembly consists of two pairs of support spacer members which are formed of cardboard material, and each member comprised of a reinforced hollow honeycomb paperboard membrane and opposed paperboard sheets. A plurality of spaced apart slots extend from an elongated edge of each of the spacer members and define shock absorbing ribs which are capable of flexing sideways in a lateral plane and twisting in torsion to receive straight or angled portions of motor vehicle windshields thereacross to support a plurality of windshields in a container and spaced from opposed side walls, bottom wall and top wall thereof. The entire support assembly is of light weight, low cost, very flexible and repulpable.

9 Claims, 2 Drawing Sheets

WINDSHIELD AND PROTECTING DIVIDER ASSEMBLY

TECHNICAL FIELD

The present invention relates to a motor vehicle windshield divider and support assembly for supporting windshields in a shipping container and wherein the assembly is formed of repulpable and recyclable cardboard material which is very flexible and of light weight.

BACKGROUND ART

It is known to package and transport windshields in shipping containers by providing a pair of divider and support assemblies, with each assembly comprised of serrated boards with a plurality of windshields extending through the serration of the boards. The boards also space the windshields from the bottom and top wall as well as the side walls of the shipping container. These divider assemblies are usually constructed of thick serrated foam sheets sandwiched between opposed cardboard layers glued thereto to provide rigidity to the ribs defined between the guide slots of the support members. However, such spacer members do provide certain disadvantages such as being brittle resulting in the breaking of ribs defined between the slots and particularly when subjected to certain bending or torsion moments, such as when placing heavy windshields across the slots. Furthermore, foam material is difficult to cut and is messy due to the freeing of lightweight foam particles. Once a rib is broken it is also not possible, or not recommended to reuse the spacer member, and it must therefore be discarded. The material is also not biodegradable, nor recyclable. This adds to the cost.

It is also known to fabricate dividers which are totally constructed of corrugated cardboard. However, these dividers are very rigid and sometimes during shipping will not absord shocks imparted thereto and cause the windshields to crack. There is therefore a need to provide a divider which has adequate flexibility and which is of low cost to fabricate.

SUMMARY OF INVENTION

It is a feature of the present invention to provide a windshield divider and support assembly for supporting two or more motor vehicle windshields spaced apart in a shipping container, and which substantially overcomes the above-mentioned disadvantages of the prior art.

Another feature of the present invention is to provide a windshield divider and support assembly comprised of spacer members which are lightweight, recyclable and repulpable, have high flexibility which are of low cost and easy to cut with a cutting tool, such as a knife, saw, etc.

Another feature of the present invention is to provide a windshield divider and support assembly wherein the spacer ribs between the support slots of the spacer members can flex laterally and in torsion, and wherein the spacer members are formed entirely of paperboard materials glued together.

According to the above features, from a broad aspect, the present invention provides a windshield divider and support assembly for supporting two or more motor vehicle windshields spaced apart. The assembly comprises two pairs of support spacer members, with each pair of spacer members having an elongated rectangular bottom support serrated board and a top elongated rectangular support serrated board. The serrated boards have a plurality of spaced apart slots extending from an elongated edge thereof. A shock absorbing flexible spacer rib is defined between adjacent ones of the slots. The boards have a structure which is formed by a thick layer of reinforcing hollow honeycomb material defining adjacent horizontal through bores, outer flat walls secured to opposed faces of said layer transverse to said through bores. The outer flat wall of the bottom support spacer members are thicker than those of the top members. The board structure permits the ribs to flex independently of one another to provide ease of access to the slots to introduce an edge portion of a windshield therein. The slots of the bottom and top support serrated boards are in alignment with one another when the bottom and top support boards are positioned in planar edge alignment with end walls of the boards aligned with one or more windshields extending transversely therebetween. Each of the support spacer members are spaced apart with the one or more windshields clamped thereacross so as to support the windshields spaced and protected from walls of a container when placed therein.

BRIEF DESCRIPTION OF DRAWINGS

A preferred embodiment of the invention will now be described with reference to the accompanying drawings in which.

DESCRIPTION OF PREFERRED EMBODIMENTS

Figures 1, 2A, 2B:
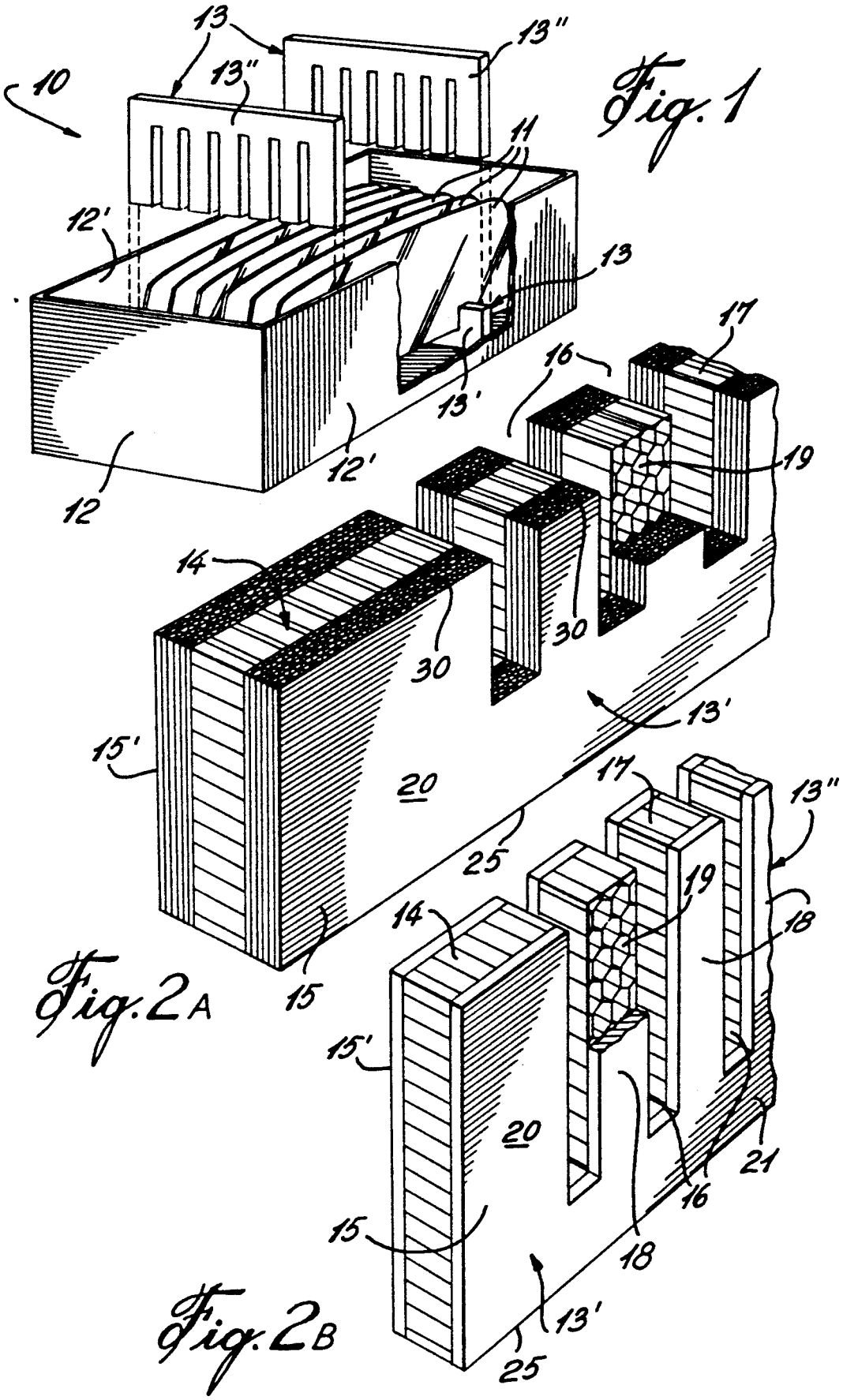
FIG. 1 is a perspective view illustrating the windshield divider and support assembly as utilized in a shipping container for shipping a plurality of motor vehicle windshields.
FIGS. 2A and 2B are fragmented perspective views showing the construction of the bottom and top support serrated board members.

Referring to the drawings, and more particularly to FIG. 1, there is shown generally at 10 the divider and support assembly of the present invention for supporting two or more motor vehicle windshields 11 in a spaced apart manner in a storage or shipping cardboard container 12. The container could also be made of other materials. The assembly comprises a pair of support spacer members 13, with each pair of spacer members comprising an elongated rectangular bottom support serrated board 13' and a top elongated rectangular support serrated board 13''. The boards are dimensioned for close fit between the side walls and top and bottom walls of the container to prevent shifting during transportation. The bottom board 13' is shorter in height than the top board and is more rigid in construction. Accordingly, the slots 16 of the top board are much deeper and the ribs are longer and more flexible.

As shown in FIG. 2, each of the serrated boards, herein board 13', has a board structure formed by a reinforcing layer or sheet 14 of hollow honeycomb material and opposed outer solid flat sidewall sheets 15 and 15' secured to opposed faces of the reinforcing sheet. The bottom board has thicker reinforced sheet material on opposed sides of its honeycomb layer 14. Each of the boards 13' and 13" has a plurality of spaced apart slots 16 extending from an elongated edge 17 thereof. A flexible shock absorbing spacer rib 18 is defined between adjacent ones of the slots 16. This structure provides spacers 13' and 13" which are very strong in compression.

The reinforced sheet 14 of hollow membrane material and the outer solid flat sheets 15 and 15' are formed of recyclable cardboard material, herein of two 0.25-point recyclable paper cardboard sheets glued together, or a solid pasted board of 0.45 points. The honeycomb board 14 is also formed of recyclable and repulpable paperboard material, and defines a plurality of hexagonal shaped through bores 19 which are disposed transverse to the outer solid flat sheets 15 to provide rigidity to the board members.

As shown in FIG. 2A, the bottom board 13' has its sidewall sheets 15 and 15' formed of at least two corrugated cardboard sheets, herein six sheets 15 and 15', with the flutes 30 extending vertically and transverse to the through bores 19 of the corrugated sheet 14 to add strenght and rigidity.

Figure 4:
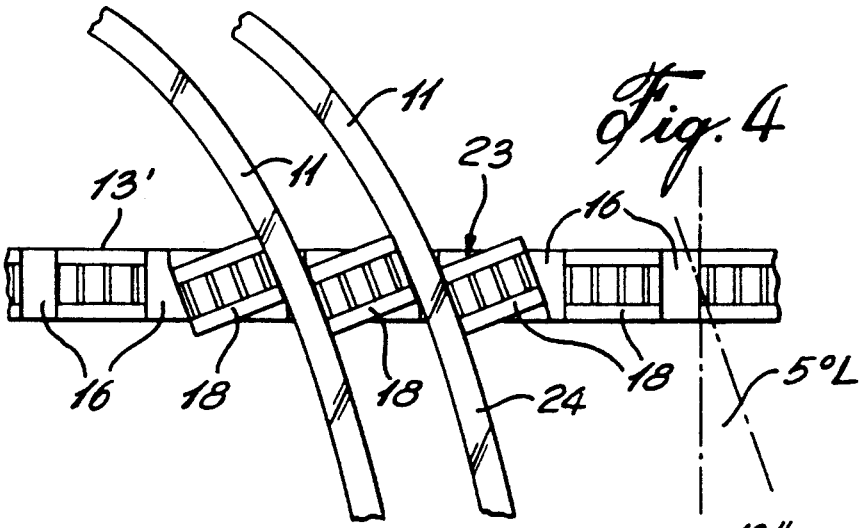
FIG. 4 is a top view of one of the support serrated board members showing the flexibility and torsion of the spacer ribs as well as their inclined edges.

As also shown in FIGS. 1 and 2, the serrated boards 13' and 13" define a wide vertical end wall portion or rib 20 at opposed ends thereof with the slots 16 extending therebetween. An elongated support and protection rib 21 is also formed adjacent the elongated bottom edge opposed to the other edge 17 which has the slots formed therein. The ribs 20 and 21 provide structural rigidity to the boards 13. The slots 16 have a width of approximately ½-inch, but could be smaller or larger depending on the thickness of the windshields intended to be supported by the members 13. The slots are also cut at a 5 degree angle as shown in FIG. 4. The bottom support member 13' has a height smaller than that of the top support serrated board. The slots in the top board extend therein to a depth of 10 to 12 inches deep. Of course, these dimensions can vary greatly depending on the size of the windshields to be supported by these support spacer members, and it is pointed out that because these are formed entirely of cardboard material, they can be easily modified with a cutting knife or a hand saw. A typical dimension for the bottom spacer member 13' is 4½inches in height ×28 inches long and 2⅜ inches thick. The top member 13" would be 14"×28"×2".

Figure 3:
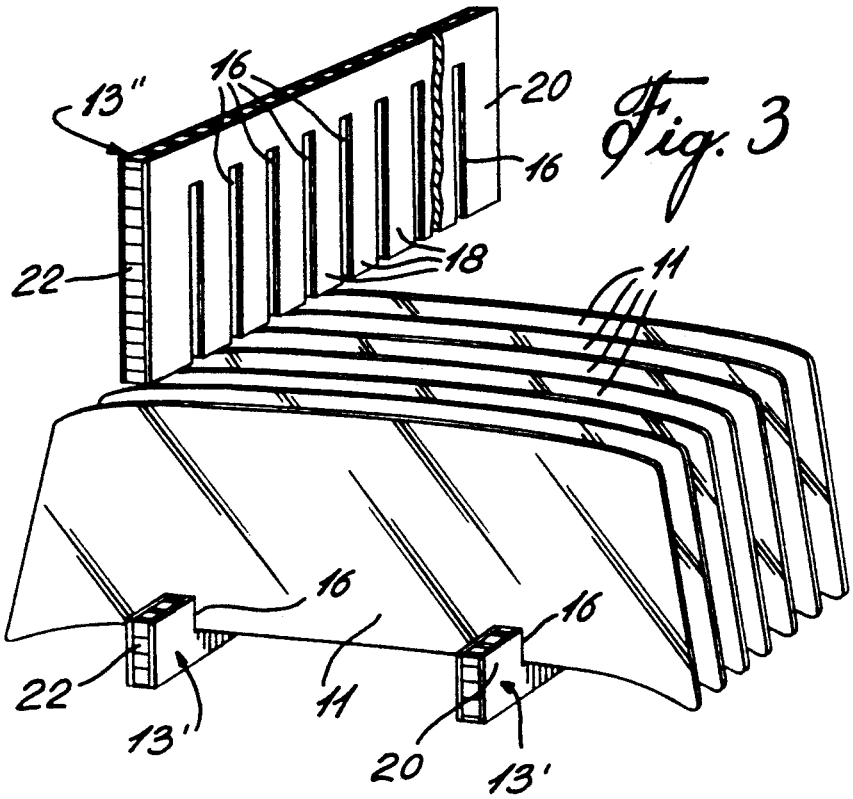
FIG. 3 is a perspective view showing the assembly of the divider and support assembly of the present invention.

To assemble windshields on these divider and support assemblies, it is necessary to dispose two of the bottom support serrated boards 13' in a spaced apart manner on a floor surface, as shown in FIG. 3, and to position the windshields thereacross in corresponding slots for storage. Alternatively, when packing the windshields in a shipping container, as shown in FIG. 1, these members 13 are disposed inside the container, and the windshields 11 are then disposed within the box in corresponding slots 16 in opposed aligned serrated boards 13'. The boards are also matched in pairs so that their inclined slots are aligned. These inclined slots also extend along the axis of curvature of the windshields. Once the correct number of windshields are positioned within the box and across the bottom support members 13', the top support members 13" are then inserted thereover with their inclined slots aligned. The top edges 17 of these boards may also abut one another or be spaced from one another. The length of these serrated boards 13' and 13" is usually selected so that the end walls 22 thereof abut the side walls 12' of the shipping container, as shown in FIG. 1.

Figure 5:
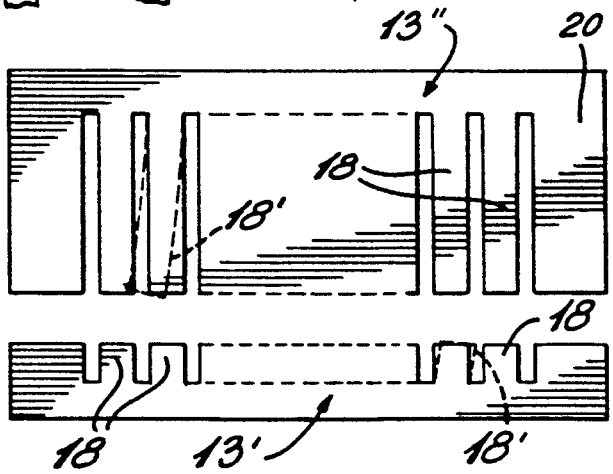
FIG. 5 is a side view showing a pair of support spacer members in alignment, and showing the side flexibility of the spacer ribs.

The advantage of constructing the serrated boards with a structure as above described is that the ribs are capable of flexing independently from one another laterally in the plane of the spacer members, as shown with rib 18' in FIG. 5, or in torsion, as shown at 23 in FIG. 4 where the ribs are imparted a torsional twist due to the angulated section 24 of the windshield 11 extending through the slots 16. The honeycomb membrane, or reinforcing sheet 14, permits this flexing and torsion without breakage and restores the original shape of the ribs after the flexion force or torsional force is removed from these ribs. Accordingly, it is expected that the spacer members of the present invention have a longer life than those of the prior art as above described. Furthermore, because the spacer members are constructed entirely from recyclable material, they are also repulpable making the product low in cost. The cardboard material also provides for a light and flexible product.

It is within the ambit of the present invention to provide any obvious modifications thereof, provided such modifications fall within the scope of the appended claims.

I claim:

1. A windshield divider and support assembly for supporting two or more motor vehicle windshields spaced apart, said assembly comprising two pairs of spacer members, each pair of spacer members having an elongated rectangular bottom serrated board and a top elongated rectangular serrated board, said serrated boards having a plurality of spaced apart slots extending from an elongated edge thereof, a shock absorbing flexible spacer rib defined between adjacent ones of said slots, said boards having a structure formed by a reinforcing sheet of hollow honeycomb material defining adjacent horizontal through bores, opposed outer flat walls secured to opposed faces of said reinforcing sheet and transverse to said through bores, said outer flat wall of said bottom support serrated board being thicker than said outer flat wall of said top, said board structure permitting said ribs to flex independently of one another to provide ease of access to said slots to introduce an edge section of a windshield therein, said slots of said bottom and top serrated boards being in alignment with one another when said bottom and top serrated boards are positioned in planar edge alignment with end walls of said boards aligned and one or more windshields extending transversely therebetween, each of said spacer members being spaced apart with said one or more windshields clamped thereacross so as to support same spaced and protected from walls of a container when placed therein.

2. A windshield divider and support assembly as claimed in claim 1 wherein said slots are angled slots extending at an angle across said opposed outer flat walls.

3. A windshield divider and support support assembly as claimed in claim 3 wherein said angled slots extend at 5 degrees to said opposed outer flat walls.

4. A motor vehicle windshield divider and support assembly as claimed in claim 1 wherein said reinforced sheet of hollow membrane material and outer flat sheets are formed of recyclable material.

5. A motor vehicle windshield divider and support assembly as claimed in claim 1 wherein said outer solid flat sheets are comprised of solid pasted recycle paperboard sheets.

6. A motor vehicle windshield divider and support assembly as claimed in claim 1 wherein said outer flat sheets are formed of corrugated cardboard having flutes extending transverse to said through bores of said honeycomb material.

7. A motor vehicle windshield divider and support assembly as claimed in claim 1 wherein said ribs are elongated rectangular ribs, said ribs being capable of flexing laterally in the plane of said board toward adjacent ribs and being capable of twisting in torsion to accommodate curved windshield sections in said slots.

8. A motor vehicle windshield divider and support assembly as claimed in claim 7 wherein said serrated boards define a wide vertical end ribs at opposed ends thereof with said plurality of slots extending therebetween, and an elongated support and protection rib adjacent an elongated edge portion opposed to said edge having said slots.

9. A motor vehicle windshield divider and support assembly as claimed in claim 6 wherein there are at least two layers of said corrugated cardboard on opposed sides of said honeycomb material.

* * * * *